US005225000A

United States Patent [19]

Fujii et al.

[11] Patent Number: 5,225,000

[45] Date of Patent: Jul. 6, 1993

[54] METHOD FOR CLEANING CLOSED SPACES WITH ULTRAVIOLET RAYS

[75] Inventors: Toshiaki Fujii; Hidetomo Suzuki; Naoaki Ogure; Kazuhiko Sakamoto, all of Kanagawa, Japan

[73] Assignee: Ebara Research Co., Ltd., Fujisawa, Japan

[21] Appl. No.: 784,512

[22] Filed: Oct. 29, 1991

[30] Foreign Application Priority Data

Nov. 2, 1990 [JP] Japan ..... 2-295422

[51] Int. Cl.[5] ..... B08B 3/12

[52] U.S. Cl. ..... 134/1; 134/42; 55/102; 55/131; 55/6; 55/279; 422/24

[58] Field of Search ..... 134/1, 2, 3, 40, 42; 55/6, 102, 2, 131, 138, 279; 209/3, 129; 422/24

[56] References Cited

U.S. PATENT DOCUMENTS 4,750,917 6/1988 Fujii ..... 55/6
5,060,805 10/1991 Fujii et al. ..... 55/102

FOREIGN PATENT DOCUMENTS 0241555 10/1987 European Pat. Off. .
63-54958 3/1988 Japan .
63-77557 4/1988 Japan .
63-147565 6/1988 Japan .

OTHER PUBLICATIONS

Sakamoto et al., Charging of Aerosol Particles by use of UV Irradiation, Man and His Ecosystem*, vol. 3 *(reprinted from) pp. 735–740, Elsevier, 1989.

*Primary Examiner*—Theodore Morris
*Assistant Examiner*—Edward Squillante
*Attorney, Agent, or Firm*—Oblon, Spivak, McClelland, Maier & Neustadt

[57] ABSTRACT

Cleaning a closed space such as safety cabinets, clean boxes, safes and wafer storage spaces are performed by irradiating a photoelectron emitting member with ultraviolet rays and/or other forms of radiation to emit photoelectrons into the closed space, electrically charging the fine particles in the closed space with the emitted photoelectrons, and removing the charged fine particles from the closed space.

1 Claim, 1 Drawing Sheet

METHOD FOR CLEANING CLOSED SPACES WITH ULTRAVIOLET RAYS

BACKGROUND OF THE INVENTION

1. Field of the Invention

The present invention relates to a method and an apparatus for cleaning closed spaces. More particularly, it relates to a method and an apparatus for trapping and removing by means of electric charging fine particles present in closed spaces.

The cleaning method and apparatus of the present invention find extensive use in the home, business offices and various industries including those of semiconductors, fine chemicals, foods, agriculture and forestry, pharmaceuticals and precision machines in cleaning closed spaces in clean rooms and germ-free rooms, as exemplified by safety cabinets, clean boxes, safes, wafer storage spaces, closed spaces for transporting valuables, clean closed spaces (either filled with various gases or in vacuo), the closed spaces of various CVD apparatus and film forming apparatus, as well as spaces wherein robots operate.

2. Prior Art

The prior art is described below with reference to FIG. 2 taking as an example the case of purifying gases in wafer storages in the semiconductor industry.

In the system shown in FIG. 2, the wafer storage space 1 which provides a closed space contains a gas 2 which is to be purified by means of a fan 3 and a high-performance filter 4. The gas 2 in the wafer storage 1 is aspirated by the fan 3 and passed through the high-performance filter 4 so that any fine particles in the gas 2 are trapped and removed to purify the gas. Since the space (or site) 1 to be cleaned is distant from the site 4 of dust collection for purification, the gas to be purified must be fluidized by the fan.

The prior art method described above is limited in its ability to purify gases and, for efficient purification, the number of times the gas 2 is circulated through the high-performance filter 4 has to be increased resulting in an increase in power consumption.

Further, with the space (site) 1 to be cleaned being remote from the site 4 of dust collection for purification, the gas has to be fluidized and this can cause problems such as the evolution of fine particles.

Also, if the closed space is in vacuo, the evolved fine particles cannot be trapped and removed rapidly from the vacuum space.

SUMMARY OF THE INVENTION

It is an object of the present invention to provide a method for cleaning closed spaces that can be implemented at a low operating cost as well as solving the aforementioned problems and which are capable of purifying such spaces in an efficient manner even if they are in vacuo.

Other objects and advantages of the present invention will become apparent to those skilled in the art from the following description and drawings.

DETAILED DESCRIPTION OF THE INVENTION

Figure 1:
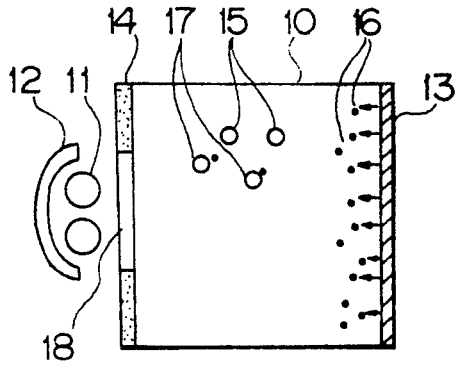
FIG. 1 is a schematic diagram showing the basic layout for implementing the cleaning method of the present invention.
Figure 2:
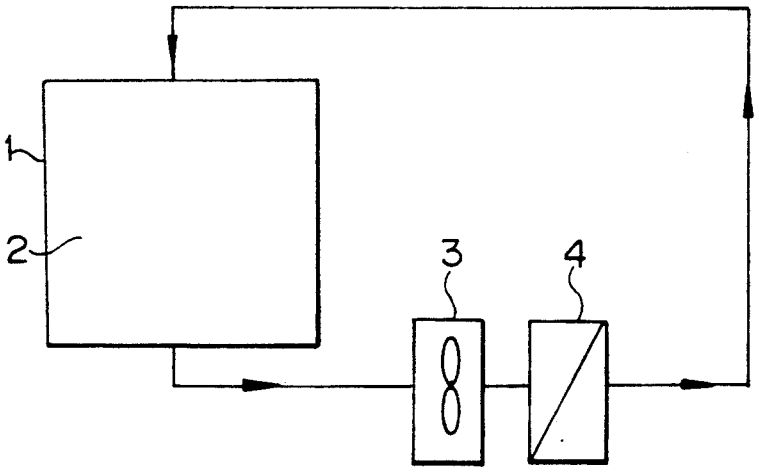
Fig. 2 PRIOR ART
FIG. 2 is a schematic diagram showing a conventional wafer storage cleaning system.

The aforementioned objects can be attained by a method of cleaning a closed space comprising the steps of irradiating a photoelectron emitting member with ultraviolet rays and/or other forms of radiation with an amount of light exposure of from 10 $\mu W/cm^2$ to 10,000 $\mu W/cm^2$ in an electric field created by applying a voltage of from 0.1 V/cm to 2 kV/cm to emit photoelectrons into said closed space, electrically charging the fine particles in said closed space with said emitted photoelectrons, and trapping charged fine particles with dust collecting members, to thereby remove the charged fine particles from the space in which electric charging is performed.

In short, the cleaning method of the present invention is characterized in that fine particles in a closed space are removed by electrically charging them with photoelectrons in the same space (site) as where the charged fine particles are trapped and removed.

The respective features of the present invention are described below in detail.

The photoelectron emitting member may be made of any material that emits photoelectrons upon exposure to ultraviolet rays and those materials which have a smaller photoelectric work function are preferred. From the viewpoint of efficiency and economy, the member is preferably made of either one of Ba, Sr, Ca, Y, Gd, La, Ce, Nd, Th, Pr, Be, Zr, Fe, Ni, Zn, Cu, Ag, Pt, Cd, Pb, Al, C, Mg, Au, In, Bi, Nb, Si, Ta, Ti, U, B, Eu, Sn and P, or compounds or alloys thereof. These materials may be used either on their own or as admixtures. Composites of these materials are also usable and an example is a physical composite such as an amalgam.

Compounds that can be used as materials for the photoelectron emitting member are oxides, borides and carbides. Exemplary oxides include BaO, SrO, CaO, $Y_2O_5$, $Gd_2O_3$, $Nd_2O_3$, $ThO_2$, $ZrO_2$, $Fe_2O_3$, ZnO, CuO, $Ag_2O$, $La_2O_3$, PtO, PbO, $Al_2O_3$, MgO, $In_2O_3$, BiO, NbO and BeO; exemplary borides include $YB_6$, $GdB_6$, $LaB_5$, $NdB_6$, $CeB_6$, $EuB_6$, $PrB_6$ and $ZrB_2$; exemplary carbides include UC, ZrC, TaC, TiC, NbC and WC.

Alloys that can be used as materials for the photoelectron emitting member are brass, bronze, phosphor bronze, alloys of Ag and Mg (2–20 wt % Mg), alloys of Cu and Be (1–10 wt % Be) and alloys of Ba and Al. Alloys of Ag-Mg, Cu-Be and Ba-Al systems are preferred. The oxides can be obtained by either heating only the metal surface in the air or oxidizing it with chemicals.

Another method that can be adopted is to heat the metal surface prior to use, whereby an oxide layer that remains stable for a prolonged time is formed on the surface. In an example of this method, an alloy of Mg and Ag is heated in steam under a temperature of 300°–400° C., whereby an oxide film is formed on the surface of the alloy. The thus formed thin oxide film remains stable for a prolonged period of time.

A photoelectron emitting member of the multiplex structure which has already proposed by the present inventors can also be used to advantage (see Japanese Patent Public Disclosure (Laid-Open) No. 155857/1989).

If desired, a material capable of emitting photoelectrons can be attached as a thin film onto a suitable matrix. In one embodiment, Au which is a material capable of emitting photoelectrons is attached as a thin film onto quartz glass that serves as a matrix, or a material that is transmissive of ultraviolet rays.

Suitable materials may be used in various shapes including a flat plate, a pleated plate, a curved plate or a screen. Preferred shapes are those which provide large areas for irradiation with ultraviolet rays and for contact with the space to be cleaned.

As already proposed by the present inventors, photoelectrons can be effectively emitted from the photoelectron emitting member by combining it with a suitable reflecting surface which may optionally be curved (see Japanese Patent Public Disclosure (Laid-Open) No. 100955/1988).

The shape of the photoelectron emitting member and the reflecting surface varies with such factors as the shape of the apparatus, its construction and the desired efficiency and suitable shapes can be properly determined in consideration of these factors.

Any kind of ultraviolet rays having a greater energy than the work function of a photoelectron emitting member may be employed as long as the photoelectron emitting member irradiated with ultraviolet radiation is capable of emitting photoelectrons. Depending on the field of application, ultraviolet rays that also have a microbicidal (sterilizing) action may be preferred. A suitable kind of ultraviolet radiation can be determined in consideration of such factors as the field of application, the operation conditions, the use and economy. In biological areas, for example, far ultraviolet rays are preferably used from the viewpoints of microbicidal action and efficiency.

Any source of ultraviolet rays can be used as long as it emits ultraviolet rays and a suitable uv source can be selected for use in consideration of various factors including the field of applications, the shape of the apparatus, its construction, efficacy and economy. Exemplary sources of ultraviolet rays that can be used include mercury lamps, hydrogen discharge tubes, xenon discharge tubes and Lyman discharge tubes. In biological areas, an ultraviolet radiation emitting at a microbicidal (sterilizing) wavelength of 254 nm is preferably used since a microbicidal (sterilizing) action is also provided.

Fine particles in a closed space can be electrically charged with high efficiency by applying ultraviolet rays to the photoelectron emitting member in an electric field.

The present inventors have already proposed effective means of charging in an electric field (see, for example, Japanese Patent Public Disclosure (Laid-Open) Nos. 178050/1986, 244459/1987 and 120653/1989).

The gas to be treated by the present invention is not flowable, so even a weak electric field is effective and voltages of 0.1 V/cm to 2 kV/cm will suffice. A suitable strength for an electric field can be properly determined from the results of preliminary testing and review in consideration of such factors as the field of application, operating conditions, the shape of the apparatus, its scale, efficacy and economy.

The member (dust collecting member) for trapping charged fine particles may be of any suitable type. While common examples are dust collecting plates and various electrode members such as dust collecting electrodes in ordinary charging devices, as well as electrostatic filters, trapping means having a wooly structure in which the trapping section itself is composed of electrodes such as steel wool electrodes and tungsten wool electrodes are also effective. If desired, electret assemblies can also be used.

Also effective are trapping methods that use ion-exchange filters (or fibers) as trapping media and that have already been proposed by the present inventors (see Japanese Patent Public Disclosure (Laid-Open) Nos. 54959/1988, 77557/1988 and 84656/1988). Ion-exchange filters are preferred for use in practical applications, since they are capable of trapping not only charged fine particles but also acidic gases, alkaline gases, odorous gases and other concomitant gases.

The type of anion-exchange filters and cation-exchange filters, the amounts in which they are used and their relative proportions may be appropriately determined in accordance with various factors such as the polarity with which fine particles in gases are electrically charged, their concentrations, or the type of concomitant acidic, alkaline or odorous gases and their concentrations.

For example, anion-exchange filters are effective for trapping negatively charged fine particles or acidic gases, whereas cation-exchange filters are effective for trapping positively charged fine particles or alkaline gases. In response to the concentrations of the materials to be trapped and their relative concentrations, the amounts in which those filters are to be used and their relative proportions may be properly determined in consideration of such factors as the field of application of equipment, its configuration, construction, operational efficiency and economy. The charged fine particles can be trapped by those methods used either individually or in combination.

Any common electrode members for creating an electric field can advantageously be used as long as they are of the type that are employed in ordinary charging devices. Electrode members for creating an electric field can also be used as members for trapping charged fine particles (i.e., as dust collecting members). Alternatively, those electrode members may be used as an integral part of the charged particle trapping members. For example, among the above-described members for trapping charged fine particles, dust collecting plates, dust collecting electrodes or wooly electrode members such as steel wool electrodes and tungsten wool electrodes are preferred since they not only serve as electrodes for creating an electric field but are also capable of trapping charged fine particles.

If desired, appropriate electrodes for creating an electric field as selected from those types which are described above may be used as an integral part of electret assemblies, ion-exchange filters or materials other than electrode members (namely, those materials which are characterized by their ability to trap fine particles).

While the method of electrically charging fine particles in a closed space has been described above with reference to the case of forming an electric field in the charging section, it should be noted that the photoelectron emitting member may be irradiated with ultraviolet rays in the absence of an electric field, whereby photoelectrons are emitted to charge the fine particles in a subject gas.

The radiation source to be applied for inducing the emission of photoelectrons from the photoelectron emitting member may be of any kind that is capable of allowing photoelectrons to be emitted from said member upon irradiation. Besides the ultraviolet radiation discussed in the foregoing embodiment, electromagnetic waves, lasers and radioactive emissions can be properly selected and used in consideration of such factors as the field of application, the scale of the apparatus, its shape and efficacy. Among these radiation sources, ultraviolet rays and radioactive emissions are usually preferred from the viewpoints of efficacy and ease of operation. Instead of ultraviolet rays, radioactive emissions may be applied to charge the fine particles and attain the same results. The amount of light exposure to photoelectron emitting members can be properly selected from the range of from 10 to 10,000 μW/cm in consideration of such factors as the type and the constitution of photoelectron emitting members, the wave length of ultraviolet rays, and the shape and constitution of the apparatus. The present inventors have already made a proposal as regards the irradiation with radioactive emissions (see Japanese Patent Public Disclosure (Laid-Open) No. 24459/1987).

The components and devices for electric charging and trapping charged fine particles (e.g. a radiation source, the photoelectron emitting member, electrodes and members for trapping charged fine particles) can be installed in suitable positions depending upon such factors as the field of application and the scale of the apparatus.

If desired, an agitating (mixing) section, for example, a fan that consumes only a small amount of power or a heating section (using convection due to temperature differences) may be installed in part of the closed space and this is preferred from the viewpoint of efficacy since sufficient agitation (mixing) can then be performed within the closed space.

The gas present in the closed space, to be cleaned by the present invention, which is in no way limited to air and other gases such as nitrogen and argon can also be treated with equal efficiency. Further, the concept of the present invention is also applicable to the case where the closed space is in vacuo. A suitable gas (including vacuo) may be properly selected in consideration of such factors as the field of applications, the type of apparatus and its scale.

The present invention is basically intended for cleaning closed spaces (or stationary spaces) but, needless to say, it is equally applicable to spaces where there is a very small amount of flowing gases.

EXAMPLE

Examples of the present invention are described below with reference to FIG. 1 but it should be understood that the present invention is by no means limited to those examples.

Example 1

The case of cleaning the air in a wafer storage space in a semiconductor plant is described with reference to the basic layout shown in FIG. 1.

The air in a closed space which, in the case under discussion, is a wafer storage space 10 (where air does not flow and may be considered to be stationary) is cleaned with a system comprising ultraviolet lamps 11 installed outside the wafer storage space 10, an ultraviolet reflecting surface 12, a photoelectron emitting member 13, an electrode 14 for creating an electric field and a charged fine particle trapping member 14 (in the system shown, the electrode also serves as the trapping member). Denoted by 18 in FIG. 1 is a glass window through which ultraviolet rays are transmitted.

Stated more specifically, the fine particles 15 in the wafer storage space 10 are electrically charged with photoelectrons 16 that are emitted from the photoelectron emitting member 13 upon irradiation with the ultraviolet lamps 11. The charged fine particles 17 are trapped by means of the trapping member 14. In other words, the charged fine particles are trapped and removed from the same space in which they are electrically charged.

In the manner described above, the fine particles (or particulate matters) in the wafer storage space 10 are trapped and removed, whereby the air in the storage space 10 is purified.

The photoelectron emitting member 13 in a plate form is efficiently irradiated with ultraviolet rays from the lamps 11 in the presence of the curved reflecting face 12.

The electrode 14 is installed in order to insure that the fine particles 15 are electrically charged in an electric field that is created between the photoelectron emitting member 13 and the electrode 14. The efficiency with which the fine particles are electrically charged is improved by irradiating the photoelectron emitting member 13 with ultraviolet rays in an electric field. In the case shown in FIG. 1, a voltage of 20 V/cm is applied to create the electric field. The charged particles are trapped by means of the dust collecting plate 14. The ultraviolet lamps 11 are germicidal lamps emitting at a dominant wavelength of 254 nm (4.9 eV); the amount of light exposure to the photoelectron emitting member 13 is 1370 $\mu W/cm^2$; the uv transmissive glass window 18 is made of quartz glass; and the photoelectron emitting member 13 is comprised of a Cu-Zn matrix having a thin film (50 Å) of Au attached thereto (work function: 4.6 eV).

Example 2

A cleaner having the construction shown in FIG. 1 was supplied with sample gases (for their composition, see below), which were irradiated with ultraviolet rays. Thereafter, the percentage of residual fine particles was measured with a particle counter.

Capacity of cleaner: 10 l

Photoelectron emitting member: Cu-Zn plate having a thin Au film (50 Å) attached thereto Electrode member: Cu-Zn plate Charged fine particle trapping member: Electrode member serving as this trapping member Ultraviolet lamps: germicidal lamps Amount of light exposure to the photoelectron emitting member: 1370 $\mu W/cm^2$ Voltage for creating electric field: 40 V/cm Sample gas (inlet gas): See below

| Carrier gas | Concentration (class) of fine particles/$ft^3$ |
|---|---|
| Air | $10^7$ |
| | $10^3$ |
| Nitrogen | $10^5$ |
| | $10^3$ |

Irradiation time: 30 min

The concentration of particles larger than 0.1 μm was measured with the particle counter.

Results

| Carrier gas | Class | Residual particles (%) |
|---|---|---|
| Air | $10^7$ | <0.01 |
| | $10^3$ | zero (undetected) |
| Nitrogen | $10^5$ | zero (undetected) |

-continued

| Carrier gas | Class | Residual particles (%) |
|---|---|---|
| | $10^3$ | zero (undetected) |

In a blank test, the sample gases were cleaned for 30 min without irradiation with ultraviolet rays and the concentration of residual fine particles was measured. The residual concentration was 90% of the initial value (inlet concentration) for each gas.

Advantages of the Invention

In accordance with the present invention, a closed space (stationary space) is cleaned by a process consisting of the steps of electrically charging the fine particles in that space by irradiation with ultraviolet rays and/or other forms of radiation and trapping and rejecting the charged fine particles from the closed space. As a result, the following advantages are achieved.

(1) Cleaning can be accomplished within a closed space, or a stationary space where there is substantially no gas flowing, and this enables the creation of a highly clean space in an efficient manner.

(2) The closed space (stationary space) can be handled (or processed) as it is, so the resulting ease of handling (or operation) contributes to the realization of an efficient cleaning method and an apparatus that is compact and cost-effective.

(3) The fine particles evolved in the closed space can also be trapped effectively, which adds to the practical utility of the present invention.

(4) The present invention can be applied not only to gases such as nitrogen and argon but also to a vacuum or a near-vacuum state, and this also increases the practical value of the invention.

(5) The feature (4) expands the scope of application of the invention and makes it suitable for cleaning closed spaces in various fields.

(6) The charged fine particles can be trapped in the same space in which charging is effected, so a cost-effective cleaning method and a compact apparatus can be realized.

(7) If desired, an electrode for creating an electric field can be used in such a way that it also serves as or forms an integral part of a member for trapping charged fine particles, and this also contributes to the realization of a compact apparatus.

What is claimed is:

1. A method of cleaning a closed space comprising the steps of irradiating a photoelectron emitting member with ultraviolet rays with an amount of light exposure of from 10 $\mu w/cm^2$ to 10,000 $\mu w/cm^2$ in an electric field created by applying a voltage of from 0.1 V/cm to 2 kv/cm to thereby emit photoelectrons into the closed space, electrically charging fine particles in the closed space with the emitted photoelectrons, and trapping the charged fine particles with fine particle collecting members, to thereby remove the charged fine particles from the closed space in which electric charging is performed, said collecting members consisting of at least one member selected from among a fine particle collecting electrode, an electrostatic filter and an ion-exchange filter or the electrode member for creating an electric field also serving as the member for trapping the charged fine particles.

* * * * *